US007285740B2

(12) United States Patent
Nakajima

(10) Patent No.: US 7,285,740 B2
(45) Date of Patent: Oct. 23, 2007

(54) TOGGLE BUTTON STRUCTURE

(75) Inventor: Hirokatsu Nakajima, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 42 days.

(21) Appl. No.: 11/186,884

(22) Filed: Jul. 22, 2005

(65) Prior Publication Data

US 2006/0163050 A1 Jul. 27, 2006

(30) Foreign Application Priority Data

Jul. 23, 2004 (JP) ..... 2004-215650

(51) Int. Cl.
*H01H 13/00* (2006.01)
*H01H 3/00* (2006.01)

(52) U.S. Cl. ..... 200/339; 200/553

(58) Field of Classification Search ..... 200/339
See application file for complete search history.

(56) References Cited

U.S. PATENT DOCUMENTS 5,329,278 A * 7/1994 Dombroski ..... 341/20
5,357,071 A * 10/1994 Hanaki ..... 200/557
5,496,977 A * 3/1996 Date et al. ..... 200/6 A
5,902,972 A * 5/1999 Nestor et al. ..... 200/1 B

FOREIGN PATENT DOCUMENTS

JP 5-041141 2/1993

OTHER PUBLICATIONS

English language Abstract of JP 05-41141.

* cited by examiner

*Primary Examiner*—Elvin Enad
*Assistant Examiner*—Lheiren Mae A. Anglo
(74) *Attorney, Agent, or Firm*—Greenblum & Bernstein, P.L.C.

(57) ABSTRACT

A button, having two end portions along a particular direction that can be selectively depressed, is supported by a support member. Pins are formed on the support member at locations corresponding to the respective two end portions of the button, the axes of the pins being perpendicular to the direction of depressing of the button. Elongate apertures are formed on the button in locations corresponding to the respective pins, the elongate apertures configured to have the pins slidably fitted therein and having their lengthwise directions generally parallel to the direction of depressing. A biasing unit is further provided to bias the button in a direction opposite to the direction of depressing. When the button is in a neutral condition, the button is biased by the biasing unit so that the pins are located respectively on one side of the elongate apertures. When one of the two end portions of the button is depressed, the button swings against the biasing force of the biasing unit using the pin located on the other of the two end portions of the button as the supporting point.

12 Claims, 5 Drawing Sheets

TOGGLE BUTTON STRUCTURE

BACKGROUND OF THE INVENTION

1. Field of the Invention

The present invention relates to structure of a toggle button, the toggle button being used in a toggle switch and the like.

2. Description of the Related Art

Conventionally; as a structure of a toggle button, for example, the one disclosed in Japanese Laid Open Patent Publication No. 1993-41141 is known. This toggle button includes a button, of which two end portions extending along a particular direction can be depressed. The center portion, along the particular direction, of the button is supported by a support member through a pin, the axis of the pin being generally perpendicular to the longitudinal direction of the button and to the direction of depressing. When one of the two end portions of the button is depressed, the button swings with the pin as the supporting point, and the depressed end portion of the button is displaced along the direction of depressing.

SUMMARY OF THE INVENTION

In the toggle button described above, in order to improve the aesthetic appearance of the toggle button, the button is embedded within a control panel and the periphery of the button is surrounded with a frame, and the surface of the button and the surface of the control panel are generally planar.

However, in the configuration where the center portion of the button along a particular direction is supported, when one of the two end portions of the button is depressed, the other end portion of the button projects outwardly toward the front side, thereby degrading the aesthetic appearance of the toggle button.

Furthermore, in the configuration described above, when the button is depressed, since the two end portions of the button move along a circular arc path with the supporting point as the center of the circular arc, the upper surface of the depressed end portion is displaced away from the supporting point along the particular direction in the case where the supporting point is located deeper than the thickness of the button below the upper surface of the button, and both the upper surface of the depressed end portion and the rear surface of the other end portion are displaced away from the supporting point along the particular direction in the case where the supporting point is located within the thickness of the button below the upper surface of the button. Therefore, the clearance between the depressed end portion and the surrounding frame becomes smaller, and it is necessary to maintain a certain degree of clearance in order to prevent interference between the depressed end portion and the frame, which is the major factor contributing to the degrading of the aesthetic appearance of the toggle button.

The present invention is provided to address the above-described situation. One purpose of the present invention is to provide a toggle button structure wherein, when one of the two end portions of the button is depressed, the other end portion of the button does not project outwardly toward the front side, and wherein the clearance between the periphery of the button and the frame surrounding the button can be made small.

According to a first aspect of the present invention, a button is provided having two end portions along a particular direction that can be selectively depressed in a depressing direction, a support member supports the button, and a biasing unit biases the button in a direction opposite to the direction of depressing. Thus, by depressing one of the end portions of the button, the depressed end portion is displaced along the direction of depressing. Pins are formed on one of the buttons or on the support member at locations corresponding to respective opposite end portions of the button, and elongate apertures are formed on the other of the button or the support member in locations corresponding respectively to the pins, the axes of the pins being generally perpendicular to the particular direction of the button and the direction of depressing, and the elongate apertures slidably receive the pins therein and extend in lengthwise directions generally parallel to the direction of depressing. The button is supported by the support member by fitting the pins in the elongate apertures, respectively. Thus, the button is biased by the biasing unit so that the pins are located respectively on one side of the elongate apertures when the button is in a neutral condition, and, when one of the end portions of the button is depressed, the button swings against the biasing force of the biasing unit using the pin located at the other end portion of the button as the supporting point.

In another aspect of the present invention, when the toggle button is in a neutral condition, each of the elongate apertures forms a generally circular arc shape with the circular arc located at the location of the pin fitted in the other elongate aperture.

According to a further aspect of the present invention, an error prevention unit is provided. With the error prevention unit, when the end portions of the button are depressed simultaneously or when the center portion between the two end portions of the button is depressed, the error prevention unit prevents the button from being displaced in a direction parallel to the direction of depressing without swinging.

In a still further aspect of the present invention, the error prevention unit includes a guide member provided on either the button or on the support member, and a guided member is provided on the other of the aforesaid button and the aforesaid support member. The guide member and the guided member are located at locations generally corresponding to the center between the two end portions of the button, and the guided member being guided by the guide member. The guide member guides the guided member in such a way as to restrict the movement of the guided member in order to prevent the button from being displaced only in a direction substantially parallel to the direction of depressing, and to permit the movement of the guided member including swinging movements of the button.

According to another aspect of the present invention, pins are formed at locations corresponding respectively to the two end portions of the button along a particular direction, and the button is supported by the support member through the pins. When one of the two end portions of the button is depressed, the button is configured to swing using the pin located at the other end portion of the button as the supporting point. Therefore, the other end portion of the button does not project significantly outwardly toward the front side.

Furthermore, since the button swings using the pin located at the end portion opposite to the depressed end portion, compared to the conventional configuration where the center portion of the button is supported, the swing radius of the depressed end portion is larger and the swing angle is smaller. Consequently, when the button is depressed, the displacement of the depressed end portion along the particular direction becomes smaller and the trace of the swinging movement of the button becomes closer to a straight line parallel to the direction of depressing. Therefore, even for the case where the button is embedded within a control panel or the like, it is possible to make the clearance between the periphery of the button and the frame surrounding the button small, thereby making it possible to improve the aesthetic appearance of the toggle button.

According to yet another aspect of the present invention, the two elongate apertures have the two pins fitted in them respectively; and, when the button is in a neutral condition, each of the two elongate apertures forms a generally circular arc shape with the circular arc located at the location of the pin fitted in the other elongate aperture. Therefore, it is possible to make the clearance between the outer periphery of the pin and the inner periphery of the elongate aperture as small as possible. For example, in the case where the shape of the elongate apertures is not a generally circular arc as described above but a shape of a straight line, in order to make the button swingable, it is necessary to make the clearance larger by a certain amount, causing the button to have a play determined by the amount of the clearance. When the shape of the elongate aperture is a generally circular arc, it is possible to make the button swingable even when the clearance is made as small as possible, thereby making it possible to minimize the play of the button. Consequently, it is possible to maintain a nearly uniform clearance at the periphery the button and enhance the aesthetic appearance of the toggle button.

According to an aspect of the present invention, an error prevention unit is provided as described above. Therefore, it is possible to positively prevent the button from being displaced in a direction parallel to the direction of depressing. For example, a toggle button is often used as a button performing mutually incompatible operations. When the button is displaced in the direction parallel to the direction of depressing, it is possible that mutually incompatible operation signals are output simultaneously. The toggle button structure of the present invention is useful for the prevention of such erroneous operations.

According to another aspect of the present invention, a guide member is provided on one of the button and the support member and a guided member is provided on the other of the button and the support member. With such a simple configuration, it is possible to positively prevent the button from being entirely displaced along the direction of depressing.

In a further aspect of the invention, a toggle button is provided that includes a button having first and second end portions that can be selectively depressed in a depressing direction, a support member that supports the button, and wherein the support member is configured to support the button such that when the button is depressed at the first end portion, the button pivots about a pivot axis formed adjacent the second end portion, and when the button is depressed at the second end portion, the button pivots about a pivot axis formed adjacent the first end portion. The toggle button may further include a biasing unit that biases the button in a direction opposite to the direction of depressing.

According to another aspect of the present invention, the toggle button the support member for the toggle button may include a pair of pins formed either on the button or on the support member at locations corresponding to respective opposite first and second end portions of the button, and a pair of elongate apertures formed on the other of the button or on the support member in locations corresponding respectively to the pins, the axes of the pins being generally perpendicular to the direction of depressing, and the elongate apertures slidably receiving the pins therein and extending in lengthwise directions generally parallel to the direction of depressing, such that the button is supported by the support member by fitting the two pins in the two elongate apertures, respectively. The toggle button may be biased by the biasing unit so that the pins are located respectively on one side of the elongate apertures when the button is in a neutral condition, and when one of the end portions of the button is depressed, the button swings against the biasing force of the biasing unit using the pin located on the other end portion of the button as the supporting point. Furthermore, when the toggle button is in a neutral condition, each of the elongate apertures may form a generally circular arc shape with the circular arc located at the location of the pin fitted in the other elongate aperture.

In another aspect of the present invention, the toggle button structure may further include an error prevention unit, wherein, when the first and second end portions of the button are depressed simultaneously or when a center portion between the end portions of the button is depressed, the error prevention unit prevents the button from being displaced in a direction parallel to the direction of depressing without swinging.

The error prevention unit may include a guide member provided on either of the button or on the support member, and a guided member which is provided on the other of the button and the support member. The guide member and the guided member may be located at locations generally corresponding to the center between the first and second end portions of the button, and the guided member may be guided by the guide member. The guide member may guide the guided member in such a way as to restrict movement of the guided member in order to prevent the button from being displaced only in the direction parallel to the direction of depressing, and to permit the movement of the guided member including the swinging movement of the button.

BRIEF DESCRIPTION OF THE DRAWINGS

The above and other objects, features and advantages of the present invention will be made apparent from the following description of the preferred embodiments, given as non-limiting examples, with reference to the accompanying drawings in which.

DESCRIPTION OF THE PREFERRED EMBODIMENTS

The following describes in detail preferred embodiments of the present invention with reference to the drawings.

Figure 1:
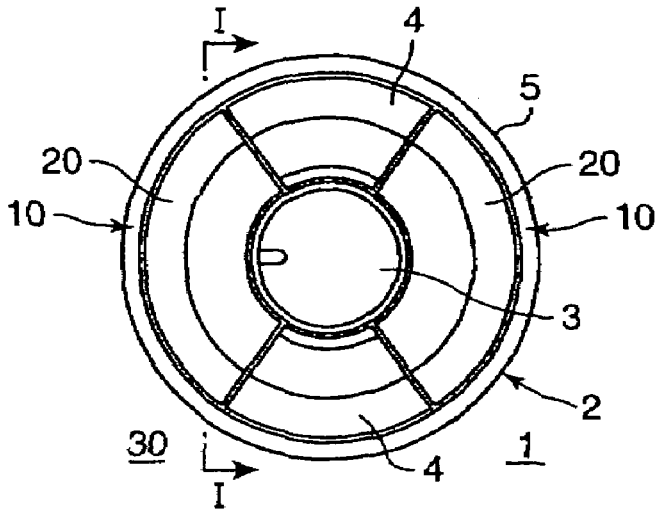
FIG. 1 is a front view of the control panel including a toggle button, the toggle button adopting the toggle button structure of the present invention.
Figure 2:
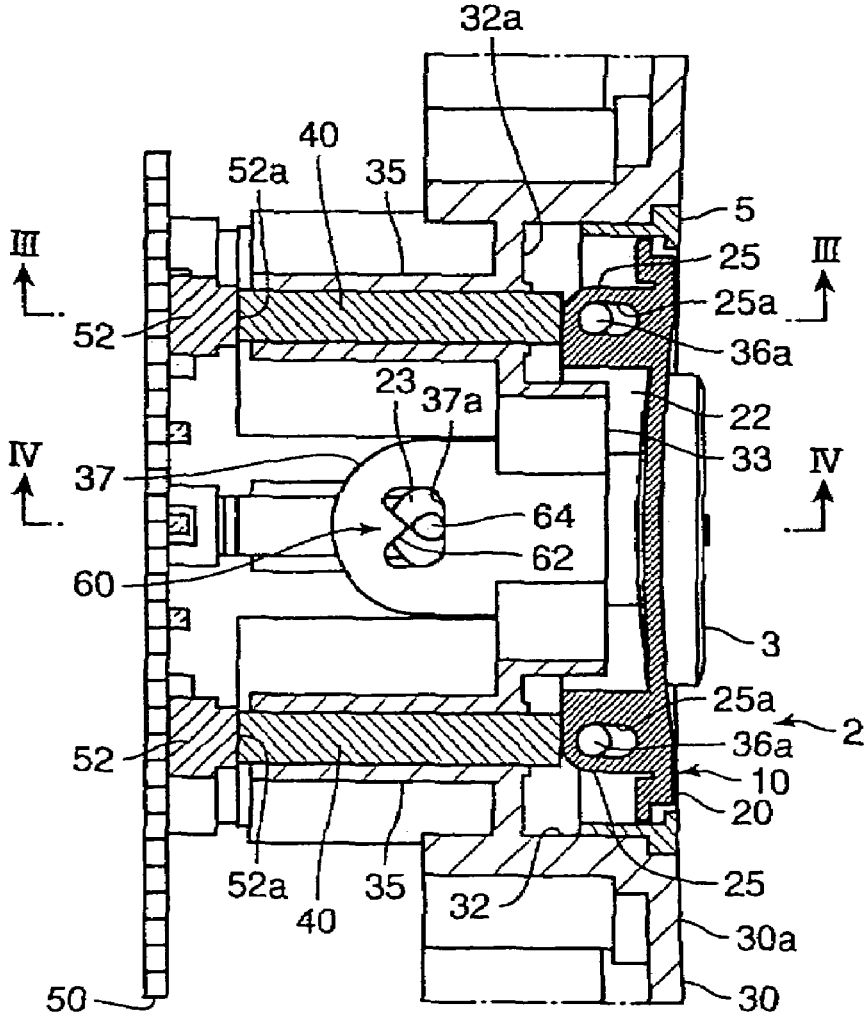
FIG. 2 is a cross-section view taken along the I-I lines in FIG. 1.

FIG. 1 and FIG. 2 show a control panel 1 having toggle button 10 embedded therein, toggle button 10 adopting the toggle button structure of the present invention. Control panel 1 can be installed in any position or location. For convenience, in explaining the current embodiment, it is assumed that control panel 1 is installed in an upstanding position.

Control panel 1 includes panel member 30, control section 2, and printed circuit board 50. Panel member 30 forms the main body of control panel 1. Control section 2 is provided inside panel member 30. Printed circuit board 50 is provided on the back side of panel member 30. A switch circuit is formed on printed circuit board 50. The switch circuit is switched ON or OFF depending on the operation of control section 2.

Control section 2 forms overall a circular shape, as shown in the figures, and includes circular-shaped button 3, arc-shaped buttons 4, and arc-shaped buttons 20. Button 3 is located at the center of control section 2. Buttons 4 are located above and below button 3. Buttons 20 are located to the left and right of button 3.

Buttons 3, 4, and 20 are placed inside recess 32, recess 32 being provided in a predetermined location in panel member 30. Recess 32 extends inwardly from panel surface 30*a* of panel member 30 and has a circular shape. By fitting buttons 3, 4, and 20 inside recess 32, buttons 3, 4, and 20 are supported by panel member 30, with the surfaces of buttons 3, 4, and 20 being generally coplanar with panel surface 30*a*.

A trim ring 5 is press-fitted between the inner periphery of recess 32 and panel surface 30*a*, thereby improving the aesthetic appearance of control section 2. And, in the present embodiment, buttons 3, 4, and 20 and panel member 30 are all made of suitable material, for example, a synthetic resin such as ABS or the like.

Among buttons 3, 4, and 20, circular-shaped button 3 and arc-shaped buttons 4 are simple push-buttons, buttons 4 being located above and below button 3. Each button 20 forms toggle button 10, buttons 20 being located to the left and right of button 3.

In the present embodiment, a pair of contact portions 52 are provided respectively in upper and lower regions on printed circuit board 50 corresponding to each of buttons 20. By selectively depressing either the upper end portion or the lower end portion of button 20, the depressing force is transmitted to a corresponding contact portion 52 through a corresponding support column 40, thereby switching contact portion 52 on or off. The support columns 40 are retained in position by panel member 30.

Each of contact portions 52 has a movable portion 52*a*, which can move along the direction of depressing. A movable contact point and a fixed contact point are provided respectively on the back side of movable portion 52*a* and on printed circuit board 50. Further, each contact portion 52 has a biasing unit built therein, the biasing unit biasing movable portion 52*a* in the direction opposite to the direction of depressing (that is, tending to keep the two contact points separated). The biasing unit is described in more detail below.

As FIGS. 4(*b*)-(*c*) show, side wall 22 is provided on the back side of button 20. Projections 25 project out from upper and lower ends of side wall 22. Projections 25 and movable portions 52*a* of contact portions 52 are respectively interconnected via support columns 40. When either the upper portion or the lower portion of button 20 is depressed, the depressing force is transmitted to movable portion 52*a* of contact portion 52 through projection 25 and support column 40, thereby overcoming the biasing force of the biasing unit of contact portion 52 and switching the contact points of contact portion 52 into the ON (in contact) condition, the support column 40 being connected with projection 25.

In other words, two projections 25 of button 20 receive equal reactive forces from the biasing units provided inside contact portions 52 through support columns 40. By these reactive forces, when button 20 is in the neutral or none-operation condition (in which button 20 is not depressed), the upper and lower portions of button 20 are biased equally along the direction (to the right in FIG. 2) opposite to the direction of depressing and are maintained in the neutral positions as shown in FIG. 2.

As the biasing unit, it is possible to use springs (not shown). It is also possible to have a configuration of the contact portion 52, in which a fixed contact point is covered with an elastic material and a movable contact point is formed on the inner surface of the elastic material; in such a configuration, the elastic material can be used as a biasing unit.

Next, the specific structure of panel member 30 for supporting button 20 and support columns 40 will be explained, with reference to FIGS. 5(*a*) and (*b*).

On bottom wall 32*a* of recess 32 of panel member 30, tubes 35 are formed, extending through bottom wall 32*a* along the thicknesswise direction of bottom wall 32*a*. Support columns 40 are slidably retained with tubes 35 for slidable motion along their axial direction (that is, the direction of depressing). A pair of holding portions 36 extend outwardly from the left and right of the upper terminal portion of tube 35 (the terminal portion closer to button 20). Holding portions 36 hold respective projections 25 of button 20, thereby restricting the movement of button 20 relative to panel member 30 along the left-right direction.

On the inner surface of each of holding portions 36, pins 36*a* are formed facing opposite each other. The axial direction of pins 36*a* is in a direction (the left-right direction in FIG. 1) generally perpendicular to the direction of depressing. On the other hand, elongate apertures 25*a* are formed respectively in projections 25 of button 20, each elongate aperture 25*a* penetrating the corresponding projection 25 in the left-right direction (the depthwise direction in FIG. 2). Pins 36*a* are fitted respectively within elongate apertures 25*a*.

With regard to the shape of elongate apertures 25*a*, generally speaking, each elongate aperture 25*a* has a shape such that its lengthwise direction is generally parallel to the direction of depressing. In the present embodiment, the shape of elongate apertures 25*a* having generally circular arcuate ends such that, when button 20 is in the neutral condition, that is, when each pin 36*a* is on the rearward end (on the side closer to printed circuit board 50, as shown in FIG. 2) of the corresponding elongate aperture 25*a*, elongate aperture 25*a* on the rearward side of button 20 has a generally circular arc shape which is centered at pin 36*a* fitted within elongate aperture 25*a*.

When one of the upper and lower end portions of button 20 is depressed, button 20 swings against the biasing force of the biasing unit using pin 36*a* on the side opposite to the depressed side as the supporting point. The depressed end portion is displaced by the distance that pin 36*a* is allowed to slide within elongate aperture 25*a*.

Furthermore, in the present embodiment, in the event that the upper and lower end portions of button 20 are depressed simultaneously or when the center portion between the two end portions is depressed, an error prevention unit 60 (see FIGS. 2, 3 and 7) is provided to prevent button 20 from being completely displaced along the direction parallel to the direction of depressing without swinging.

Error prevention unit 60 includes guide member 62 and guided member 64, guide member 62 being formed on panel member 30, guided member 64 being formed on button 20, and guided member 64 being guided by guide member 62.

More specifically, as FIG. 4(*d*) shows, extending portions 23 extend respectively from the left and right sides of side wall 22 of button 20 toward the printed circuit board 50 side (the front side in FIG. 4(*c*)). Guided members 64 are formed on the inner walls of extending portions 23.

Guided members 64 are formed on locations generally corresponding to the center between the upper and lower end portions of button 20. Guided members 64 are generally cylinder-shaped, projecting outwardly so as to face each other. The periphery of each guided member 64 extends slightly toward the printed circuit board 50 side to form projecting portion 64*a* (see FIG. 3).

Figure 5B:
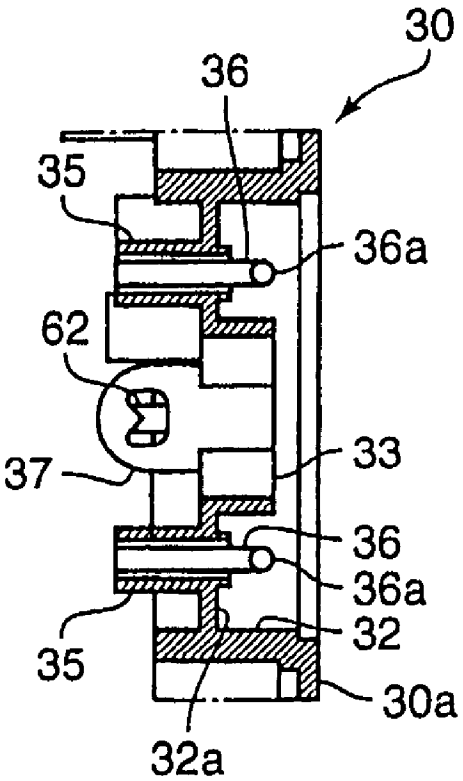
FIGS. 5(*a*) and (*b*) show a support member according to the present invention, where FIG. 5(*a*) is a front view and FIG. 5(*b*) is a cross-section view taken along the II-II line in FIG. 5(*a*)
Figure 5A:
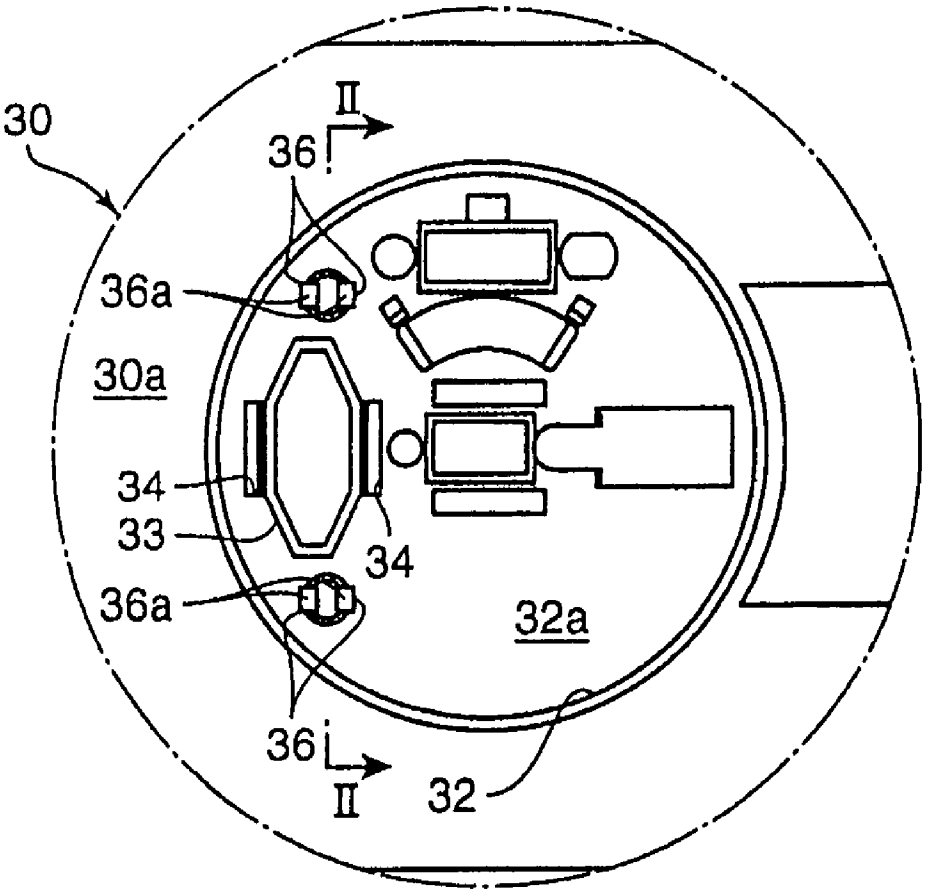
Figure 6:
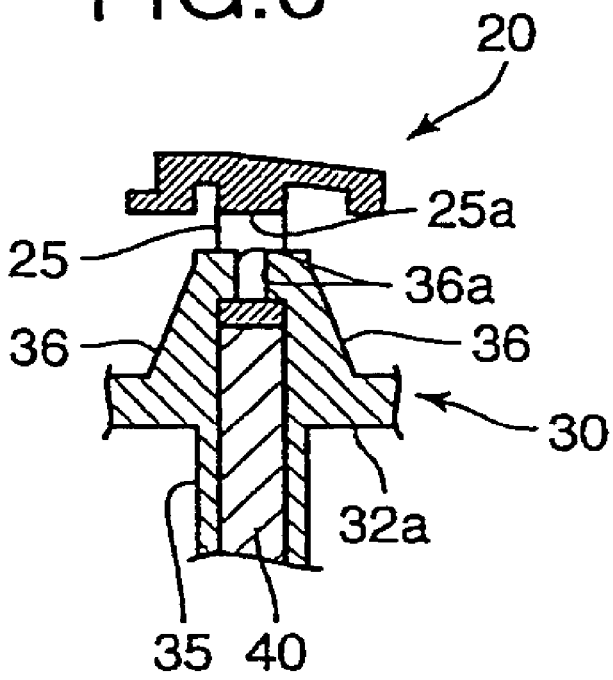
FIG. 6 is a cross-section view showing the relation between the button and the support member when viewed in the direction of line III-III in FIG. 2.

On the other hand, as FIGS. 5(*a*) and (*b*) show, tubular portion 33 is formed on bottom wall 32*a* of recess 32 of panel member 30 and is located at the back side of the center portion of button 20. Generally rectangular through-holes 34 are formed in bottom wall 32*a* adjacent to tubular portion 33 on the left and right sides thereof, respectively, thus penetrating bottom wall 32*a*. Therefore, extending portions 23 of button 20 can project outwardly through the through-holes 34 to the back side (the left side in FIG. 5(*b*)) of bottom wall 32*a*.

A pair of tongues 37 protrude from the back side of bottom wall 32*a*, tongues 37 forming walls that are continuations of the side walls of tubular portion 33 parallel to the left-right direction, and through-holes 37*a* are formed on tongues 37 permitting tongues 37 to penetrate through in the thickness direction, thereby providing guide member 62.

Figure 3:
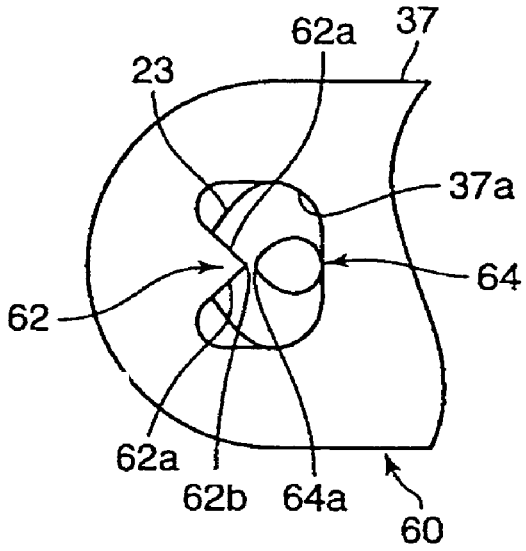
FIG. 3 is an enlarged view of a relevant part shown in FIG. 2.
Figure 4A:
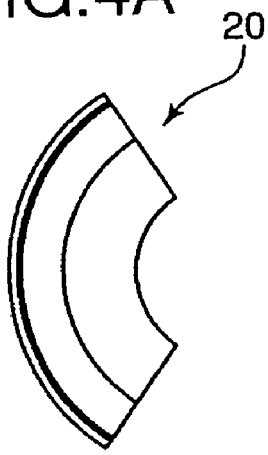
FIGS. 4(*a*)-(*d*) show a button according to the present invention, where FIG. 4(*a*) is a front view, FIG. 4(*b*) is a right side view, FIG. 4(*c*) is a rear view, and FIG. 4(*d*) is a lower side view.
Figure 4B:
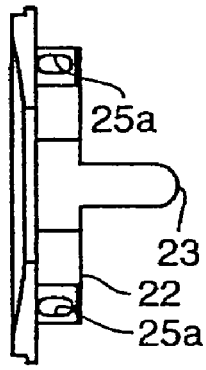
Figure 4C:
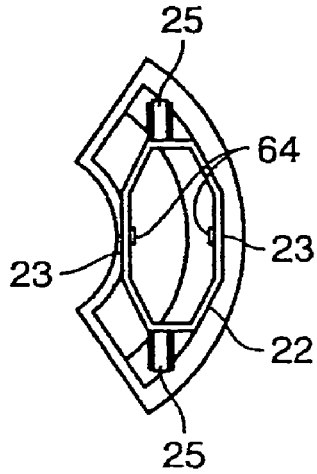
Figure 4D:
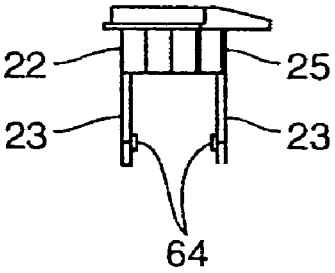

Through-hole 37*a* forms a generally heart-shaped opening extending in the direction opposite to the extending direction of tongue 37. As FIG. 3 shows, on the inner periphery of through-hole 37*a*, the portion that projects inwardly toward the button 20 side forms the guide member 62 that guides guided member 64. Guide member 62 includes peak 62*b* and guiding surfaces 62*a*. Peak 62*b* is the projecting portion. Guiding surfaces 62*a* use peak 62*b* as a dividing line and extend to the left and right of peak 62*b*.

Figure 7:
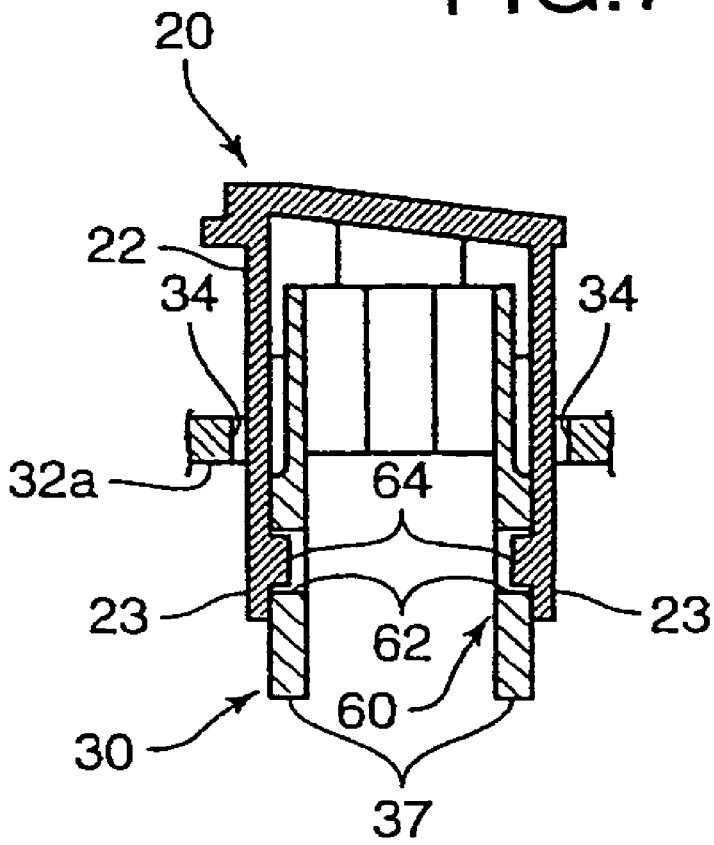
FIG. 7 is a cross-section view showing the relation between the button and the support member when viewed in the direction of line IV-IV in FIG. 2.

As FIG. 7 shows, extending portions 23 of button 20 project through through-holes 34 of panel member 30 to the back-side of bottom wall 32*a*. Guided members 64 are inserted into through-holes 37*a*, through-holes 37*a* being formed on tongues 37.

The shapes of guide member 62 and guided member 64 are designed such that the following conditions are satisfied.

First, as FIG. 3 shows, when button 20 is in the neutral condition, peak 62*b* of guide member 62 faces toward projecting portion 64*a* of guided member 64. In such a condition, when button 20 is about to make a parallel movement entirely along the direction of depressing, such parallel movement of button 20 is prevented by restricting the movement of guided member 64 by contact between projecting portion 64*a* of guided member 64 and peak 62*b* of guide member 62.

Second, when button 20 is making movements other than the above-described parallel movement, by the misalignment between the positions of projecting portion 64*a* of guided member 64 and peak 62*b* of guide member 62, projecting portion 64*a* of guided member 64 slides on one of guiding surfaces 62*a* of guide member 62, so that button 20 is guided to swing to the direction opposite to the direction that guided member 64 is guided to.

In the following, the function of toggle button 10 will be explained.

Figure 8:
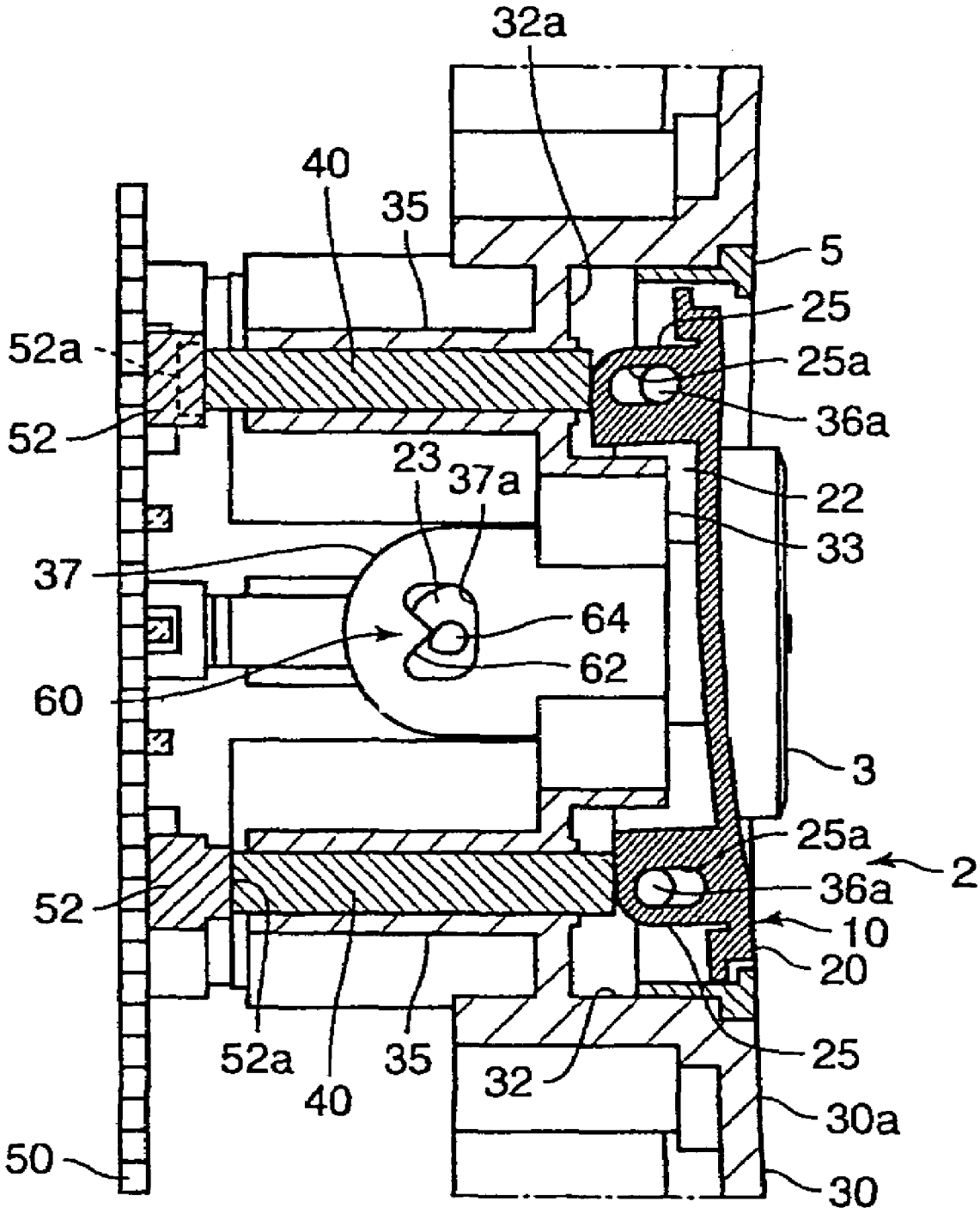
FIG. 8 is a cross-section view taken along the I-I line in FIG. 1 when the button is pressed.

When one of the upper and lower end portions of button 20 in the neutral position shown in FIG. 2 is depressed, the depressed end portion is displaced against the biasing force of the aforesaid biasing unit, as shown in FIG. 8. The displacement of the end portion on the opposite side of the depressed end portion is restricted by the biasing force of the biasing unit and by the shape of elongate aperture 25*a*. Therefore, button 20 swings using the pin located at the side opposite to the depressed side as the supporting point.

When depressing the upper or lower portion of button 20, it is not always necessary to depress on an edge portion. It is acceptable as long as the depressed location is away from the center between the two end portions.

Support column 40 located on the depressed side of button 20 moves with the displacement of button 20 and depresses movable portion 52*a* of contact portion 52, and the ON or OFF switching of the switch circuit on printed circuit board 50 is performed.

When depressing is released, movable portion 52*a* is returned to its original position by the biasing unit of contact portion 52, and support column 40 moves and pushes the depressed end portion of button 20, thereby returning button 20 to its original condition.

As described above, in the present embodiment, pins 36*a* are formed at locations corresponding to respectively the upper and lower end portions of button 20, and button 20 is supported by panel member 30 through pins 36*a* on the two sides. When one of the two end portions of button 20 is depressed, button 20 is configured to swing using pin 36*a* located on the side opposite to the depressed side as the supporting point; therefore, the end portion of button 20 on the side opposite to the depressed side does not project out significantly toward the front side.

Furthermore, since button 20 swings using pin 36*a* located on the end portion opposite to the depressed end portion as the supporting point, compared to the conventional configuration where the center portion of the button is supported, the swing radius of the depressed end portion can be made larger and the swing angle of button 20 can be made smaller. Consequently, when button 20 is depressed, the displacement of the depressed end portion along the up-and-down direction becomes smaller, and the trace of the swinging movement of button 20 becomes closer to a straight line parallel to the direction of depressing. Therefore, it is possible to reduce the clearance between the periphery of button 20 and frame 5, thereby enhancing the aesthetic appearance of control section 2 which has toggle button 10 embedded therein.

Since the trace of the swinging movement of button 20 is nearly a straight line parallel to the direction of depressing, when button 20 is depressed, it is possible to reduce the pressure acting on support column 40 along a direction other than the direction of depressing, thereby minimizing damage to support column 40 and the parts guiding support column 40.

When button 20 is in a neutral condition, each of the two elongate apertures 25*a* forms a circular arc shape which is centered at pin 36*a* fitted in elongate aperture 25*a* on the opposite side. Therefore, it is possible to make the clearance between the outer periphery of pin 36*a* and the inner periphery of elongate aperture 25*a* as small as possible. For example, in the case where the shape of elongate apertures 25*a* is not a circular arc as described above but a shape of a straight line, in order to make button 20 swingable, it is necessary to make the aforesaid clearance larger by a certain amount, causing button 20 to have play determined by the amount of the clearance. When the shape of elongate aperture 25*a* is a circular arc, it is possible to make the aforesaid clearance as small as possible and still be able to make button 20 swingable, thereby making it possible to minimize the play of button 20. Consequently, it is possible to maintain a nearly uniform clearance on the periphery of button 20 and enhance the aesthetic appearance.

Furthermore, in the present embodiment, error prevention unit 60 is provided. Therefore, it is possible to positively prevent button 20 from being entirely displaced in a direction parallel to the direction of depressing. For example, toggle button 10 is often used as a button performing mutually incompatible operations. When button 20 is displaced only in a direction parallel to the direction of depressing, it is possible that mutually incompatible operation signals are output simultaneously. However, the toggle button 10 of the present invention is useful for the prevention of such erroneous operations.

Specifically, in the present embodiment, guide member 62 is provided on panel member 30 and guided member 64 is provided on button 20. With such a simple configuration, it is possible to positively prevent button 20 from being entirely displaced in a direction parallel to the direction of depressing.

In the embodiment described above, pins 36*a* are provided on panel member 30 and elongate apertures 25*a* are provided on button 20. However, it is also possible to provide pins 36*a* on button 20 and elongate apertures 25*a* on panel member 30. It is also possible to do the same place-switching for guide member 62 and guided member 64.

With regard to error prevention unit 60, it is not always necessary to have guide member 62 and guided member 64. For example, it is also possible to provide a bar in the location corresponding generally to the center portion between the upper and lower end portions of button 20 to restrict any displacement of the aforesaid center portion beyond the displacement associated with the swinging motion of button 20.

And, in the embodiment described above, toggle button 10 is placed inside control section 2, control section 2 having a plurality of buttons. However, it is not limited to this configuration. Even when toggle button 10 is used by itself, toggle button 10 can still adopt the toggle button structure of the present invention.

Furthermore, button 20 is not necessarily circular arc shaped as in the embodiment described above. It is also possible to make button 20 to have a generally circular or generally rectangular shape. Also, it is not always necessary to have the two end portions of button 20 that can be selectively depressed located along the lengthwise direction of button 20; it is also possible to have the two end portions located along the widthwise direction of button 20.

It is also possible to have a configuration which does not include side wall 22 of button 20 and tubular portion 33 of panel member 30.

In the embodiment describe above, support columns 40 are provided between button 20 and printed circuit board 50. However, it is also possible to omit support columns 40.

Furthermore, it is not necessary to provide the biasing unit in contact portion 52. It is also possible to provide the biasing unit between button 20 and bottom wall 32*a* of panel member 30.

It is also possible to prevent button 20 from being entirely displaced in the direction parallel to the direction of depressing by making the clearance between the inner periphery of elongate aperture 25*a* and the outer periphery of pin 36*a* as small as possible. In this case, it is possible to omit error prevention unit 60.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The present disclosure relates to subject matter contained in priority Japanese Application No. 2004-215650, which was filed on Jul. 23, 2004, which is herein expressly incorporated by reference in its entirety.

The invention claimed is:

1. A toggle button comprising:

a button having two end portions that can be selectively depressed in a depressing direction;

a support member which supports said button; and a biasing unit that biases said button in a direction opposite to the direction of depressing; and a pair of pins formed either on said button or on said support member at locations corresponding to respective opposite end portions of said button, and a pair of elongate apertures formed on the other of said button or on said support member in locations corresponding respectively to the pins, the axes of the pins being generally perpendicular to the direction of depressing, and the elongate apertures slidably receiving the pins therein and extending in lengthwise directions generally parallel to the direction of depressing; wherein said button is supported by said support member by fitting said two pins in said two elongate apertures, respectively;

said button is biased by said biasing unit so that said pins are located respectively on one side of said elongate apertures when said button is in a neutral condition; and when one of said end portions of said button is depressed, said button swings against the biasing force of said biasing unit using the pin located on the other end portion of said button as the supporting point.

2. The toggle button structure according to claim 1 wherein, when said button is in a neutral condition, each of said elongate apertures form a generally circular arc shape with the circular arc located at the location of the pin fitted in the other elongate aperture.

3. A toggle button comprising:

a button having two end portions that can be selectively depressed in a depressing direction;

a support member which supports said button; and a biasing unit that biases said button in a direction opposite to the direction of depressing; and a pair of pins formed either on said button or on said support member at locations corresponding to respective opposite end portions of said button, and a pair of elongate apertures formed on the other of said button or on said support member in locations corresponding respectively to the pins, the axes of the pins being generally perpendicular to the direction of depressing, and the elongate apertures slidably receiving the pins therein and extending in lengthwise directions generally parallel to the direction of depressing; wherein said button is supported by said support member by fitting said two pins in said two elongate apertures, respectively;

said button is biased by said biasing unit so that said pins are located respectively on one side of said elongate apertures when said button is in a neutral condition; and when one of said end portions of said button is depressed, said button swings against the biasing force of said biasing unit using the pin located on the other end portion of said button as the supporting point; and further comprising an error prevention unit, wherein, when said end portions of said button are depressed simultaneously or when a center portion between said end portions of said button is depressed, said error prevention unit prevents said button from being displaced in a direction parallel to the direction of depressing without swinging.

4. The toggle button structure according to claim 3, wherein said error prevention unit comprises a guide member provided on either of said button or on said support member, and a guided member which is provided on the other of said button and said support member, said guide member and said guided member being located at locations generally corresponding to the center between said two end portions of said button, and said guided member being guided by said guide member; and said guide member guides said guided member in such a way as to restrict movement of said guided member in order to prevent said button from being displaced only in the direction parallel to the direction of depressing, and to permit the movement of said guided member including the swinging movement of said button.

5. The toggle button structure according to claim 3, wherein said error prevention unit comprises a guide member provided on either of said button or on said support member, and a guided member which is provided on the other of said button and said support member, said guide member and said guided member being located at locations generally corresponding to the center between said two end portions of said button, and said guided member being guided by said guide member; and said guide member guides said guided member in such a way as to restrict movement of said guided member in order to prevent said button from being displaced only in the direction parallel to the direction of depressing, and to permit the movement of said guided member including the swinging movement of said button.

6. A toggle button comprising:

a button having two end portions that can be selectively depressed in a depressing direction;

a support member which supports said button; and a biasing unit that biases said button in a direction opposite to the direction of depressing; and a pair of pins formed either on said button or on said support member at locations corresponding to respective opposite end portions of said button, and a pair of elongate apertures formed on the other of said button or on said support member in locations corresponding respectively to the pins, the axes of the pins being generally perpendicular to the direction of depressing, and the elongate apertures slidably receiving the pins therein and extending in lengthwise directions generally parallel to the direction of depressing; wherein said button is supported by said support member by fitting said two pins in said two elongate apertures, respectively;

said button is biased by said biasing unit so that said pins are located respectively on one side of said elongate apertures when said button is in a neutral condition; and when one of said end portions of said button is depressed, said button swings against the biasing force of said biasing unit using the pin located on the other end portion of said button as the supporting point wherein, when said button is in a neutral condition, each of said elongate apertures form a generally circular arc shape with the circular arc located at the location of the pin fitted in the other elongate aperture; and further comprising an error prevention unit, wherein, when said end portions of said button are depressed simultaneously or when a center portion between said end portions of said button is depressed, said error prevention unit prevents said button from being displaced in a direction parallel to the direction of depressing without swinging.

7. A toggle button comprising:

a button having first and second end portions that can be selectively depressed in a depressing direction; and a support member that supports said button;

wherein said support member is configured to support said button such that when said button is depressed at said first end portion, said button pivots about a pivot axis formed adjacent said second end portion, and when said button is depressed at said second end portion, said button pivots about a pivot axis formed adjacent said first end portion; and wherein said support member further comprises a pair of pins formed either on said button or on said support member at locations corresponding to respective opposite end portions of said button, and a pair of elongate apertures formed on the other of said button or on said support member in locations corresponding respectively to the pins, the axes of the pins being generally perpendicular to the direction of depressing, and the elongate apertures slidably receiving the pins therein and extending in lengthwise directions generally parallel to the direction of depressing; wherein said button is supported by said support member by fitting said two pins in said two elongate apertures, respectively.

8. The toggle button structure according to claim 7, wherein said button is biased by a biasing unit so that said pins are located respectively on one side of said elongate apertures when said button is in a neutral condition; and when one of said end portions of said button is depressed, said button swings against the biasing force of said biasing unit using the pin located on the other end portion of said button as the supporting point.

9. The toggle button structure according to claim 8, wherein, when said button is in a neutral condition, each of said elongate apertures form a generally circular arc shape with the circular arc located at the location of the pin fitted in the other elongate aperture.

10. The toggle button structure according to claim 7, further comprising an error prevention unit, wherein, when said end portions of said button are depressed simultaneously or when a center portion between said end portions of said button is depressed, said error prevention unit prevents said button from being displaced in a direction parallel to the direction of depressing without swinging.

11. The toggle button structure according to claim 10, wherein said error prevention unit comprises a guide member provided on either of said button or on said support member, and a guided member which is provided on the other of said button and said support member, said guide member and said guided member being located at locations generally corresponding to the center between said two end portions of said button, and said guided member being guided by said guide member; and said guide member guides said guided member in such a way as to restrict movement of said guided member in order to prevent said button from being displaced only in the direction parallel to the direction of depressing, and to permit the movement of said guided member including the swinging movement of said button.

12. The toggle button structure according to claim 7, further comprising a biasing unit that biases said button in a direction opposite to the direction of depressing.

* * * * *